US007836810B2

(12) United States Patent
Meyer

(10) Patent No.: US 7,836,810 B2
(45) Date of Patent: Nov. 23, 2010

(54) PROTECTED VEHICLE OR SHIP

(75) Inventor: Helmut Meyer, Halstenbek (DE)

(73) Assignee: Drehtainer GmbH Spezial Container-und Fahrzeugbau, Valluhn Mega Park (DE)

( * ) Notice: Subject to any disclaimer, the term of this patent is extended or adjusted under 35 U.S.C. 154(b) by 38 days.

(21) Appl. No.: 11/918,316

(22) PCT Filed: Apr. 11, 2006

(86) PCT No.: PCT/EP2006/003324

§ 371 (c)(1),
(2), (4) Date: Dec. 10, 2008

(87) PCT Pub. No.: WO2006/108613

PCT Pub. Date: Oct. 19, 2006

(65) Prior Publication Data

US 2009/0145290 A1 Jun. 11, 2009

(30) Foreign Application Priority Data

Apr. 12, 2005 (DE) ..... 20 2005 005 921 U
Apr. 26, 2005 (DE) ..... 20 2005 006 655 U

(51) Int. Cl.
*F41H 7/04* (2006.01)

(52) U.S. Cl. ..... 89/36.17; 89/1.1; 180/271; 296/187.08

(58) Field of Classification Search ..... 89/1.1, 89/1.11, 36.17; 180/271, 282, 289; 296/187.07, 296/187.08, 193.07
See application file for complete search history.

(56) References Cited

U.S. PATENT DOCUMENTS

| | | | | |
|---|---|---|---|---|
| 3,087,369 | A * | 4/1963 | Butterfield | 411/391 |
| 3,530,759 | A * | 9/1970 | Francis | 411/391 |
| 4,523,731 | A * | 6/1985 | Buitekant et al. | 244/137.4 |
| 5,119,555 | A * | 6/1992 | Johnson | 29/254 |
| 5,136,925 | A * | 8/1992 | Spariat et al. | 89/1.14 |
| 5,160,233 | A * | 11/1992 | McKinnis | 411/433 |
| 5,245,738 | A * | 9/1993 | Johnson | 29/413 |
| 6,371,410 | B1 * | 4/2002 | Cairo-Iocco et al. | 244/100 A |
| 6,592,283 | B1 * | 7/2003 | Vidot | 403/11 |
| 6,658,984 | B2 * | 12/2003 | Zonak | 89/36.08 |
| 6,779,431 | B2 * | 8/2004 | Honlinger | 89/36.08 |
| 6,892,621 | B2 * | 5/2005 | Grosch | 89/1.11 |
| 6,925,939 | B2 * | 8/2005 | Cleveland | 102/378 |

(Continued)

FOREIGN PATENT DOCUMENTS

DE 196 31 715 2/1998

(Continued)

*Primary Examiner*—Benjamin P Lee
(74) *Attorney, Agent, or Firm*—Merek, Blackmon & Voorhees, LLC

(57) ABSTRACT

The invention relates to a vehicle equipped with seats and/or equipment for use in areas in which the detonation of mines or the like are feared, wherein walls, floor and ceiling are provided with an arrangement that can withdraw energy from the blast wave of a detonation by deformation, and the floor is suspended only through ropes, rods or chains with separable connections. At least one pressure sensor and/or acceleration sensor is provided, which reacts to a blast wave, outputs a signal and ignites explosive charges thereby. The explosive charges (11) are arranged at the separable connections (8) and these are broken before the blast wave of a detonation has reached the floor (10).

2 Claims, 2 Drawing Sheets

U.S. PATENT DOCUMENTS

| | | | | |
|---|---|---|---|---|
| 7,228,927 | B2 * | 6/2007 | Hass et al. | 180/65.25 |
| 7,255,034 | B2 * | 8/2007 | Strassgurtl et al. | 89/36.08 |
| 7,401,540 | B1 * | 7/2008 | Kocher | 89/36.08 |
| 7,537,073 | B2 * | 5/2009 | Kalliske et al. | 180/69.24 |
| 7,594,561 | B2 * | 9/2009 | Hass et al. | 180/299 |
| 7,644,799 | B2 * | 1/2010 | Friedman et al. | 180/282 |
| 2003/0010189 | A1 * | 1/2003 | Zonak | 89/36.08 |
| 2004/0200347 | A1 | 10/2004 | Grosch | |
| 2004/0211612 | A1 * | 10/2004 | Muller | 180/271 |
| 2006/0027083 | A1 * | 2/2006 | Lee et al. | 89/1.14 |
| 2006/0175116 | A1 * | 8/2006 | Friedman et al. | 180/282 |

FOREIGN PATENT DOCUMENTS

| | | | |
|---|---|---|---|
| DE | 197 02 398 | C1 | 7/1998 |
| DE | 198 42 629 | C1 | 3/2000 |
| EP | 1 045 220 | A | 10/2000 |
| EP | 1 293 747 | A | 3/2003 |
| GB | 2 302 526 | A | 1/1997 |
| WO | 03/004958 | A | 1/2003 |

* cited by examiner

PROTECTED VEHICLE OR SHIP

CROSS-REFERENCE TO RELATED APPLICATIONS

The present application claims the priorities under 35 U.S.C. 119 of German Application No. 20 2005 005 921.8, filed Apr. 12, 2005, and of German Application No. 20 2005 006 655.9, filed Apr. 26, 2005, which are hereby incorporated herein by reference in their entireties.

The invention relates to a vehicle equipped with seats and/or equipment for use in regions in which the detonation of mines or the like is feared, wherein walls, floors and ceiling are equipped with means withdrawing energy from the blast wave of a detonation by deformation, and the floor is only suspended through ropes, rods or chains with separable connections.

In passenger transportation in regions where the presence of explosive mines is feared, containers protected against blast waves are utilized as armored vehicles (DE 198 42 629 C1), although these have not proven themselves sufficiently, and that also in that case, they are formed with wall, floor and ceiling linings, which deform under the influence of pressure and thus withdraw the largest part of the energy of the blast wave. In a vehicle equipped in this manner, it cannot be prevented that such a strong blast wave is produced by a mine that its force bears on the floor and beneath the seats, and can accelerate the seat with the person sitting thereon such that the person is seriously injured or the equipment there is destroyed.

An object of the invention is to solve this problem. The invention is intended to provide a vehicle or a ship, respectively, of the type indicated above, with an arrangement wherein the energy of a blast wave created by a detonation cannot reach the floor with people and equipment situated thereon.

In general this is achieved according to the invention in that, at the time of the formation of a blast wave created by a detonation, the floor of the vehicle is mechanically released from a state of suspension and is, in the ideal case, in the state of free fall at the time of the arrival of the blast wave.

By such a suspension, and by breaking a separable connection, the floor is made shockproof during a mine explosion.

A required sensor system serves to detect an arising shock wave, to measure and evaluate it, and to ignite explosive or pyrotechnical charges in the area of the separable connections. After the destruction of the break-off connections, the floor of the vehicle moves freely in space and cannot be reached by the blast waves of a detonation, such that especially a vertical decoupling is achieved. However, the invention can be utilized equally effectively to separate the floor laterally from the body of the vehicle, when a detonation occurs laterally of the vehicle. The point is, in this regard, that the lateral attachment of the floor at the vehicle body is broken systematically and that, before the arrival of the blast wave, a connection with a bolt and an eye is released according to the invention.

Special safety can be achieved in that, when, for example, in a recreation room formed as a container which is transported like a usual container, the floor is secured in the vertical and the horizontal directions with a separable connection according to the invention.

Shearing pins that have been utilized in the art, which are intended to break the force flow between parts connected with each other in case of overload, are much too inert with regard to the propagation speed of a blast wave. They would break a connection after the blast wave has already developed its destructive effect. Thus, it is a special aspect of the present invention to accomplish this break within a shorter period of time, i.e., the explosive charge for the bolt reacts within a period of time less than 1 or 2 ms. The blast wave itself reaches the floor only after 4 ms, assuming that the vehicle is located directly above a detonating mine.

In order to ensure that the floor does not fall without limitation, after the explosive charges have been ignited, either a stop can be provided or the suspension itself can be utilized again, by using an oblong eye, in which first a retractable bolt (also indicated as a pin puller) is situated in an operative connection, and a second pin is arranged at a distance above it, which is loaded, when the bolt has been retracted.

The invention is explained below based on the drawings by way of example.

Figure 1:
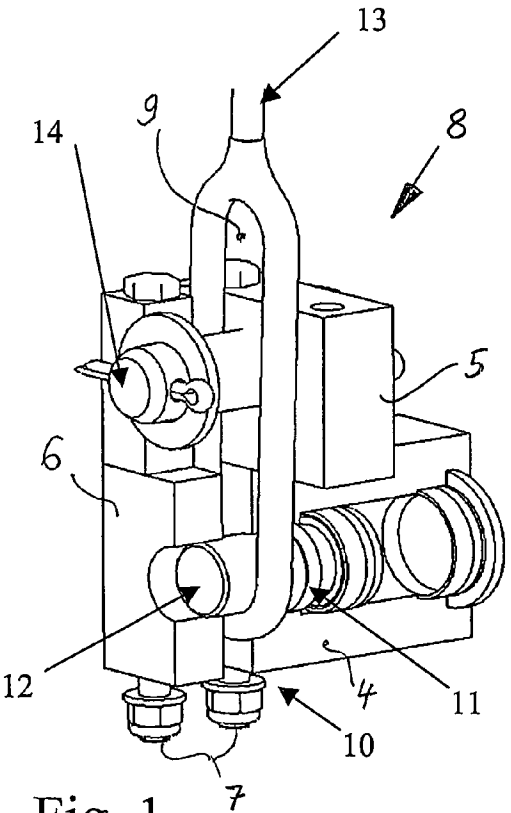
FIG. 1 shows a break-off connection for a vehicle or ship according to the invention in the normal state.

In FIG. 1 the reference numbers for the individual parts are inserted, which can also be recognized in the other figures.

These show a separable connection 8 according to the invention.

The floor of a military passenger vehicle or recreation room is attached at 10 by means of bolt connections 7 to a block 4, 5, 6, at which a pin 12 and a catching pin 14 are mounted at different levels. The two pins project into an oblong hole or eye 9 of a fastener 13, which is fixed in the top area approximately at the ceiling of a vehicle according to the invention.

The pin 12 rests in the lower part of the oblong hole 9, and this is the normal case, i.e., the condition before any detonation.

The pin 12 is provided with an explosive charge 11, which can be ignited through a pressure sensor, not shown.

After the ignition of the explosive charge 11, the connection between the pin 12 and the fastener 13 is broken such that the floor 10 can fall freely. The shock wave passes the way starting from the side wall (post) to the rope suspension only when the mechanical separation has already occurred.

The downward movement of the floor is stopped after a few centimeters, because the catching pin 14 comes into engagement with the lower end of the suspension part 13. The distance between the two pins 12 and 14 can be chosen such that the floor 10 moves freely during the detonation and, after the fading away of the blast waves caused by the detonation, a firm connection is established between the floor 10 and the ceiling of the vehicle again.

Figure 3:
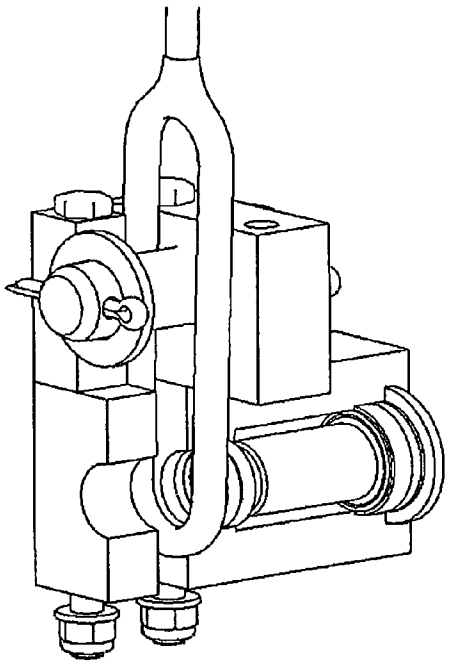
FIG. 3 shows a corresponding arrangement, in which the catching pin has come into operation.
Figure 2:
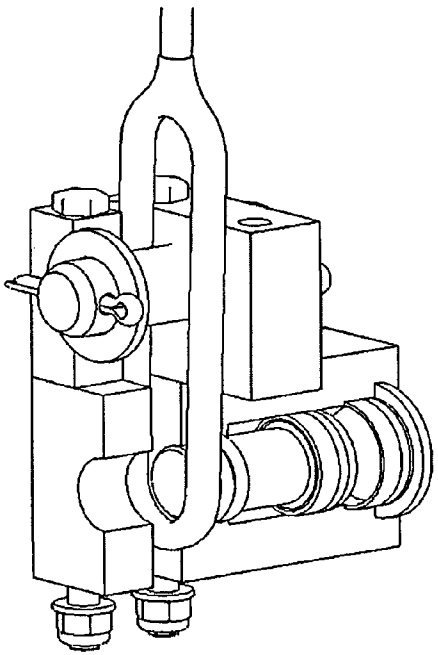
FIG. 2 shows a corresponding situation shortly before the ignition of the explosive charge of the break-off connection.
Figure 4:
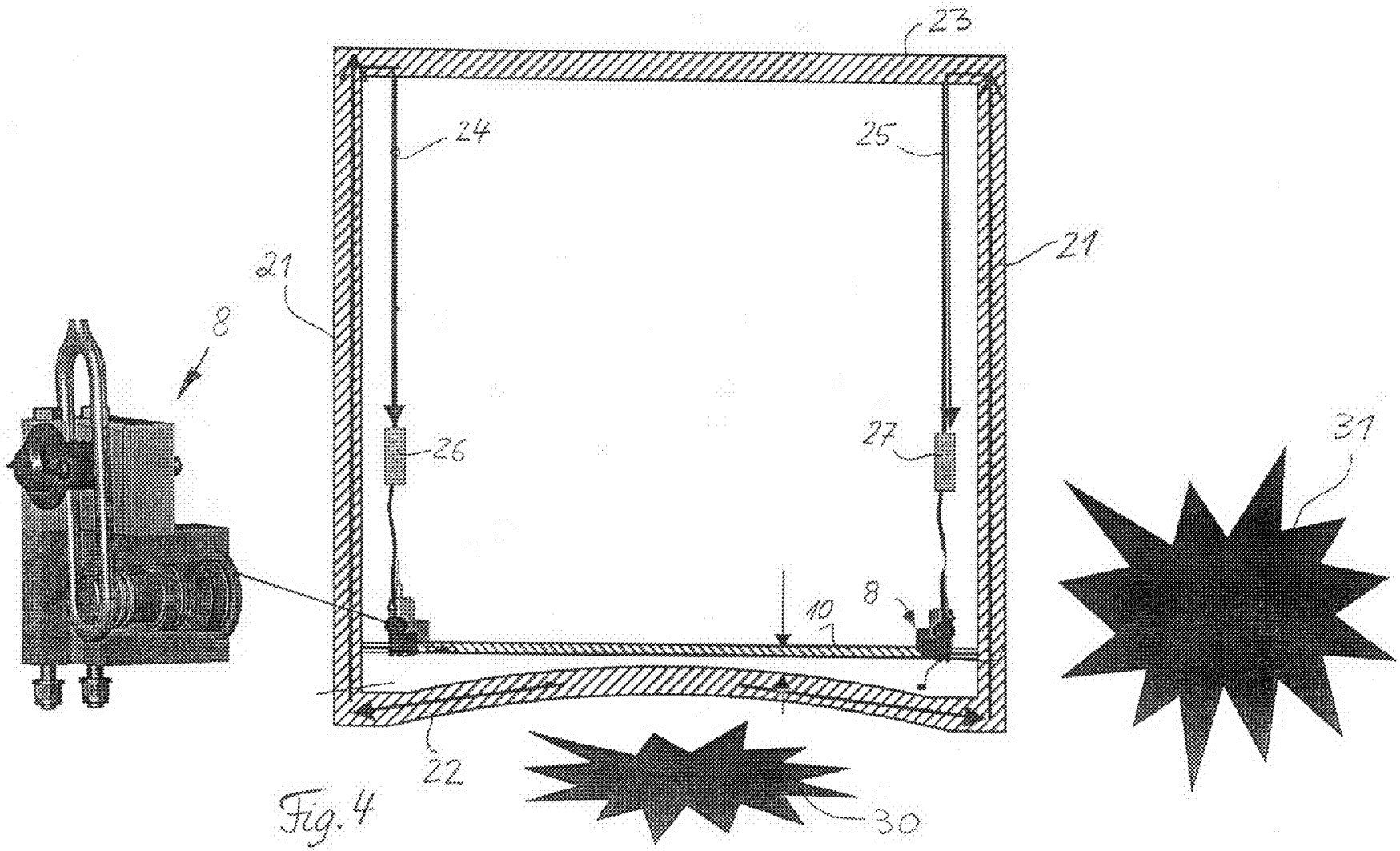
FIG. 4 shows a vertical sectional view through a transport container, which has been equipped according to the invention.

In FIG. 4 a vertical cross-sectional view through a container is shown, which is formed by two side walls 21, a ceiling 23 and a floor 22 (already deformed). In the interior, the real floor 10 is located, on which equipment can be put down or persons can stand or sit on chairs. This floor 10 is mounted through rope suspensions at several points, for example at four points at the ceiling 23 of the container. Ropes 24 and 25 as well as shock absorbers 26 and 27 serve this purpose. The lower end of these suspensions is formed by the separable connections 8, which have already been described in connection with FIGS. 1 to 3. One of these separable connections 8 is shown only graphically on an altered scale such that the spatial arrangement of such a separable connection can be recognized.

In FIG. 4, 30 shows graphically a detonation that has occurred directly below the vehicle and has caused the deformation of the floor 22 of the container. The effects of this detonation 30 cannot reach the floor 10, though, because the mechanical connection was released earlier.

In FIG. 4 a lateral detonation 31 is shown as well, and it is obvious to connect the floor 10 of the recreation room with the side walls 21 in a corresponding manner through releasable separable connections.

It is essential for the present invention that sensors can detect a detonation wave at a time when the real shock wave has still not become noticeable in the vehicle. Thus, it is essential to detect accelerations (such as in the manner of an airbag) or pressure variation speeds and to trigger an ignition signal correspondingly. Such sensors are known. They can be included in an evaluation circuit that decides within the shortest time which releasable connections are to be separated to reduce the danger for humans and goods to a minimum. The present invention has been shown in connection with a bolt or pin, which can be moved in its longitudinal direction as a result of an explosive charge, in order to break the connection of forces flowing between the floor and the suspension. It is obvious to utilize any other part instead of the bolt that breaks the connection between the floor and the suspension in a corresponding manner. Also, the arrangement of the sensors is not critical. Mounting a sensor close to a break off-connection has the advantage of short "switching paths".

What is claimed is:

1. Vehicle equipped with seats and/or equipment for use in regions, in which detonations by mines or the like are to be feared, wherein a vehicle housing comprising walls, floor and ceiling is provided with means, which can withdraw energy from the blast wave of a detonation by means of deformation, and an additional floor within the vehicle housing is suspended only through ropes, rods or chains by means of separable connections, characterised in that at least one pressure sensor and/or acceleration sensor is provided, which reacts to a blast wave, outputs a signal and ignites explosive charges thereby, and that the explosive charges (11) are arranged at said separable connections (8) of said additional floor, the explosive charges breaking said separable connections (8) before the blast wave of a detonation has reached the additional floor (10).

2. Vehicle according to claim 1, characterised in that said separable connection is formed as a moveable bolt (12), which is arranged at the additional floor (10) and projects into an eye (9), which in turn is mounted at the rope (24, 25), rod or chain, and that the ignited explosive charge (11) can move the bolt (12) out of the eye (9).

* * * * *